United States Patent [19]

Fee

[11] Patent Number: 4,625,912

[45] Date of Patent: Dec. 2, 1986

[54] RAILWAY FASTENING ASSEMBLY

[75] Inventor: Graham M. Fee, Geneva, Ohio

[73] Assignee: True Temper Railway Appliances, Inc., Chicago, Ill.

[21] Appl. No.: 262,710

[22] Filed: May 11, 1981

Related U.S. Application Data

[63] Continuation-in-part of Ser. No. 240,411, Mar. 4, 1981, and Ser. No. 228,804, Jan. 27, 1981, Pat. No. 4,442,793, and a continuation of Ser. No. 57,823, Jul. 16, 1979, abandoned, said Ser. No. 240,411, is a continuation of Ser. No. 930,232, Aug. 2, 1978, abandoned, said Ser. No. 228,804, is a continuation of Ser. No. 933,630, Aug. 14, 1978, abandoned.

[51] Int. Cl.[4] ..... E01B 9/30

[52] U.S. Cl. ..... 238/349; 238/338

[58] Field of Search ..... 238/310, 315, 338, 343, 238/349

[56] References Cited

U.S. PATENT DOCUMENTS

| | | | |
|---|---|---|---|
| 2,009,309 | 7/1935 | Davies et al. | 238/283 |
| 2,530,547 | 11/1950 | Snyder | 238/349 |
| 3,688,984 | 9/1972 | Sonneville | 238/349 |
| 3,700,167 | 10/1972 | Jennings et al. | 238/349 |
| 3,717,302 | 2/1973 | Neumann | 238/287 |
| 3,887,128 | 6/1975 | Ruble | 238/349 |
| 4,067,495 | 1/1978 | Qureshi | 238/349 |
| 4,073,435 | 2/1978 | Miller | 238/349 |
| 4,074,860 | 2/1978 | Rex | 238/349 |
| 4,104,483 | 8/1978 | Seeley | 238/349 X |

FOREIGN PATENT DOCUMENTS

| | | | |
|---|---|---|---|
| 255468 | 7/1967 | Austria . | |
| 1120489 | 7/1962 | Fed. Rep. of Germany . | |
| 1534017 | 3/1970 | Fed. Rep. of Germany . | |
| 2741238 | 4/1978 | Fed. Rep. of Germany | 238/349 |
| 109912 | 1/1974 | German Democratic Rep. . | |
| 1044884 | 10/1966 | United Kingdom | 238/349 |
| 1154497 | 6/1969 | United Kingdom . | |
| 1305871 | 2/1973 | United Kingdom | 238/349 |
| 1486451 | 9/1977 | United Kingdom . | |
| 1496390 | 12/1977 | United Kingdom | 238/349 |
| 1519349 | 7/1978 | United Kingdom | 238/349 |
| 2034788 | 6/1980 | United Kingdom | 238/349 |

*Primary Examiner*—Randolph A. Reese

*Attorney, Agent, or Firm*—John K. Williamson; John L. LaPierre

[57] ABSTRACT

A rail fastening assembly for securing a railway rail to a support therefor, comprising a retaining chair secured to the rail suport, such as a tie. The retaining chair includes a head having an inner side and an outer side with a recess formed in the head. An S-shaped torsional spring rail clip having a central leg is received in seating engagement in the recessed head of the retaining chair, with the terminal legs of the clip coacting with respectively a ramp on the retaining chair and a base flange of the railway rail, for establishing a torsional spring force on the central leg of the clip, and securing the railway rail to the support. The recess in the head is disposed on the outer side of the head facing away from the rail. In one embodiment an insulator is disposed intermediate the base flange of the rail and the terminal leg portion of the clip that holds the rail in place, for electrically and mechanically insulating the retaining chair and the rail clip from the rail. In another embodiment the terminal leg of the clip directly engages the rail base flange; an electrical insulating covering may be provided on the retaining device where it is secured to the support for electrically insulating the retaining device from the support. An insulating tie pad is disposed between the base of the rail and the tie in the embodiments illustrated.

30 Claims, 28 Drawing Figures

RAILWAY FASTENING ASSEMBLY

CROSS-REFERENCE TO RELATED APPLICATIONS

The present application is a continuation of copending Ser. No. 57,823 filed July 16, 1979, now abandoned, and is a continuation-in-part of copending applications Ser. No. 240,411 filed Mar. 4, 1981 which is a continuation of Ser. No. 930,232 filed Aug. 2, 1978, now abandoned, and this application is also a continuation-in-part of Ser. No. 228,804 filed Jan. 27, 1981, now Pat. No. 4,442,793, which is a continuation of Ser. No. 933,630 filed Aug. 14, 1978, now abandoned, all of which are incorporated herein by reference and relied upon.

The present invention relates in general to a fastening assembly for securing a railway rail having a laterally projecting base flange to a support, and more particularly relates to a rail fastening assembly which includes a retaining chair adapted to be secured to a support such as a tie, adjacent the base flange of the rail, and a generally S-shaped, in plan, spring rail clip adapted to be forced onto the head of the retaining chair, with one of the terminal legs of the clip being adapted to engage a cam on the retaining chair, and the other terminal leg of the clip being adapted to hold the rail flange down against the rail support, with the center leg of the clip being received in seated engagement on the retaining chair head for establishing a torsional force on the center leg, and with the retaining chair being positionable in close proximity to the rail.

BACKGROUND OF THE INVENTION

In applicant's copending U.S. patent application Ser. No. 930,232, filed Aug. 2, 1978, and copending U.S. patent application Ser. No. 933,620, filed Aug. 14, 1978 entitled Improvements in Rail Fastening Assemblies, there are disclosed various S-shaped clips cooperating with a retaining chair for securing a railway rail to a support. There is also disclosed in the aforesaid patent applications an insulator which is adapted to coact with the clip, for electrically and mechanically insulating the rail from the retaining device and clip. Moreover, there are many other various and diverse types of railway fastening assemblies well known in the prior art which embody clips (with and without resilient pads) for holding down railway rails (e.g. U.S. Pat. Nos. 2,530,547 and 2,009,309). In the aforementioned prior pending patent applications, the retaining chair has a recess formed in the head thereof for receiving the clip with the recess in the retaining chair head facing the rail. During laying of the rails on such support members, the rail's base flange may become snagged in the recessed retaining chair head, and it is generally desirable therefore, to maintain a certain amount of spacing between the retaining chair head and the position where the rail is to be placed, in the interests of expeditious laying of the track. This of course results in spacing of the retaining device a relatively great distance laterally from the rail base flange which is adapted to be held down by the clip assembled with the retaining chair.

SUMMARY OF THE INVENTION

The present invention provides a rail fastening assembly wherein the retaining chair is adapted for positioning relatively close to the base flange on the rail, and with the means on the retaining chair head for receiving the central leg of a generally S-shaped (in plan) spring clip in seating engagement, being disposed on the outer side of the head facing away from the rail. The retaining chair head is so constructed and arranged so as to facilitate the guiding of the rails into position during the operation of laying the rails on the support ties. The clip is provided with a detent adapted for coaction with a coacting part of the fastener assembly, for resisting removal of the clip after it has been forced into assembled relation with the retaining chair. In one embodiment, a replaceable insulator or shim is provided, for electrically and mechanically insulating the rail from the fastener assembly, with the retaining chair being provided with a pocket which allows for vertical movement of the insulator relative to the retaining chair, but which positively positions the insulator relative to the retaining chair. In another embodiment, the clip directly engages the base flange of the rail, and insulation of the fastening assembly from the tie support may be provided by a coating of insulating material on the depending leg of the retaining chair which secures the retaining chair to the tie support.

Accordingly, it is an object of the invention to provide an improved rail fastening assembly.

Another object of the invention is to provide a rail fastening assembly which is of simplified construction and which will operate efficiently in providing rail holding force to secure a railway rail to a support, such as a tie.

A still further object of the invention is to provide a rail fastening assembly which aids in placement of the rails on their support, and without the possibility of snagging of the rail on the retaining device secured to the support.

A still further object of the invention is to provide a rail fastening assembly for securing a railway rail having a laterally projecting base flange, to a support, with the assembly comprising a generally S-shaped, in plan, torsional spring rail clip including a central leg and a retaining chair bearing portion and a rail bearing portion spaced on opposite sides and extending from opposite ends of the central leg, with retaining chair means secured to the support adjacent the base flange of the rail, with the retaining chair means including a head having means thereon adapted to receive the central leg of the clip in seating engagement therewith, for establishing a torsional spring force on the central leg, for securing the rail to the support, and with the last mentioned means being positioned on the outer side of the head of the retaining chair facing in a direction away from the rail.

Other objects and advantages of the invention will be apparent from the following description taken in conjunction with the accompanying drawings wherein:

DESCRIPTION OF PREFERRED EMBODIMENTS

Figure 1:
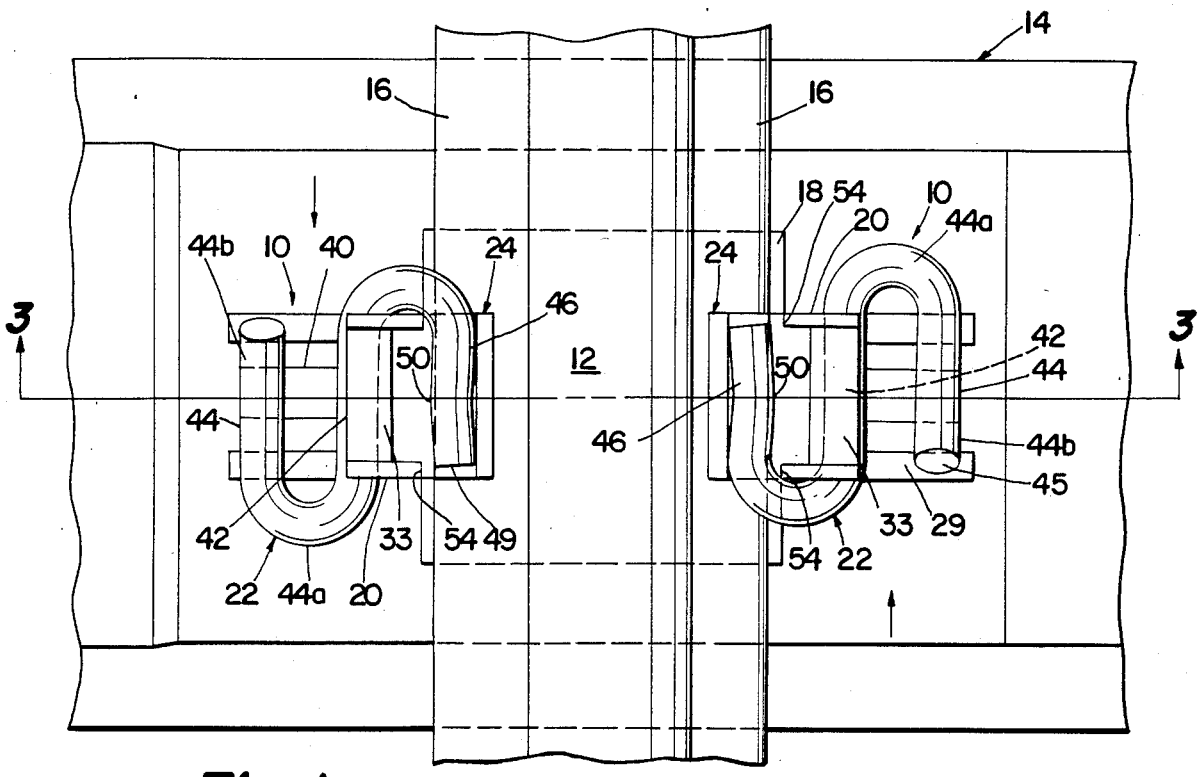
FIG. 1 is a top plan, fragmentary, illustration of a pair of the rail fastening assemblies in accordance with the invention, anchoring a railway rail to a support.
Figure 2:
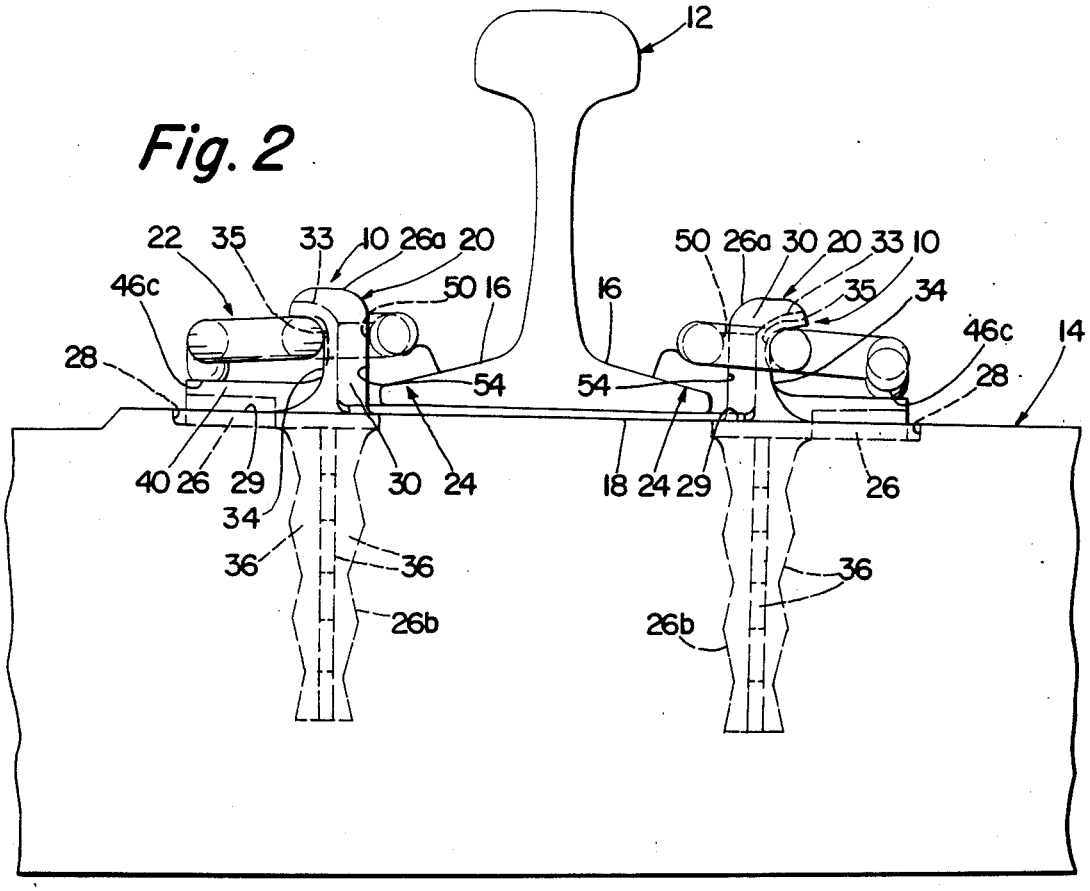
FIG. 2 is an end elevational view of FIG. 1.

Referring in particular to FIGS. 1-4, there is illustrated a rail fastening assembly 10 anchoring a section of railway rail 12 to a support, which in the embodiment illustrated, in a concrete tie 14. Rail 12 includes conventional laterally projecting base flanges 16, each of which, in the embodiment illustrated, has one of the fastener assemblies 10 associated therewith, for securing the railway rail 12 to the support 14. In the embodiment illustrated, a tie pad 18 is disposed between the tie 14 and the underside of the base of the rail 12, as best shown in FIGS. 1 and 2. Pad 18 may be formed of any suitable material, but in the embodiment illustrated is preferably comprised of high density polyethylene, which electrically and mechanically insulates the metal rail 12 from the support 14.

Each fastening assembly 10 comprises, in the embodiment illustrated, a retaining chair 20 secured to the support 14, as will be hereinafter discussed in greater detail, a generally S-shaped (in plan) torsional spring clip 22, which is adapted to be forced onto the retaining chair 20 in seating engagement therewith, and an insulator or shim 24, interposed between the rail bearing portion of the spring clip 22, and the associated flange 16 of the rail, and coacting therewith for not only securing the rail to the support 14, but also electrically and mechanically insulating the rail from the fastener assembly.

Figure 3:
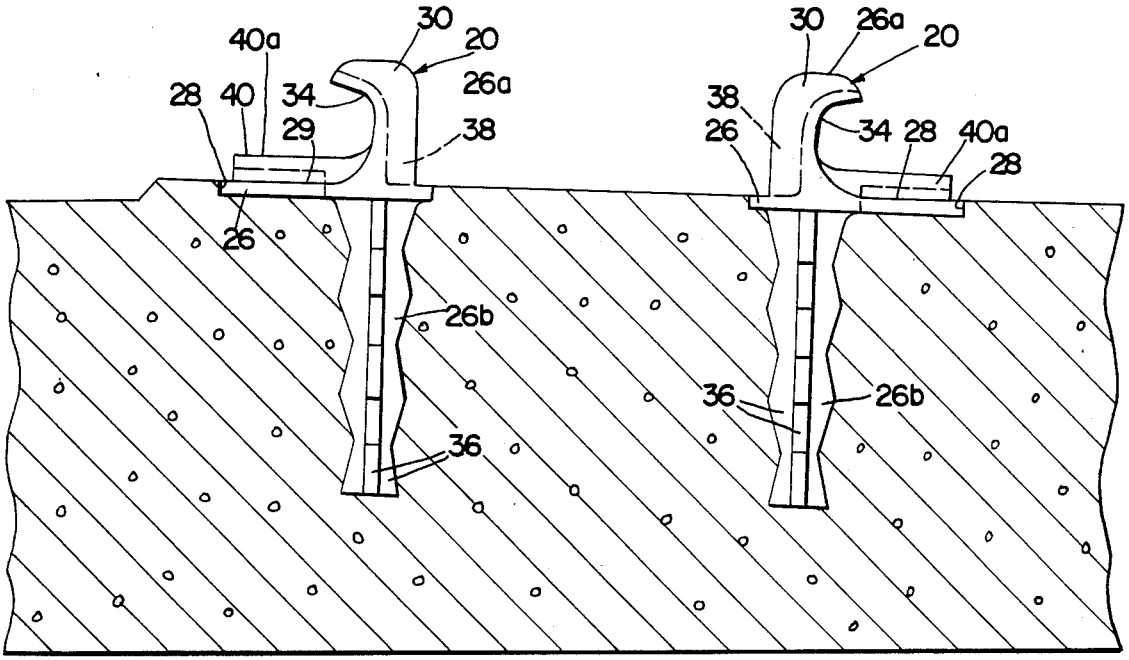
FIG. 3 is a sectional view taken generally along 3—3 of FIG. 1, but with the rail, S-clips and insulators eliminated, ready to receive a rail between the spaced retaining chair.
Figure 5:
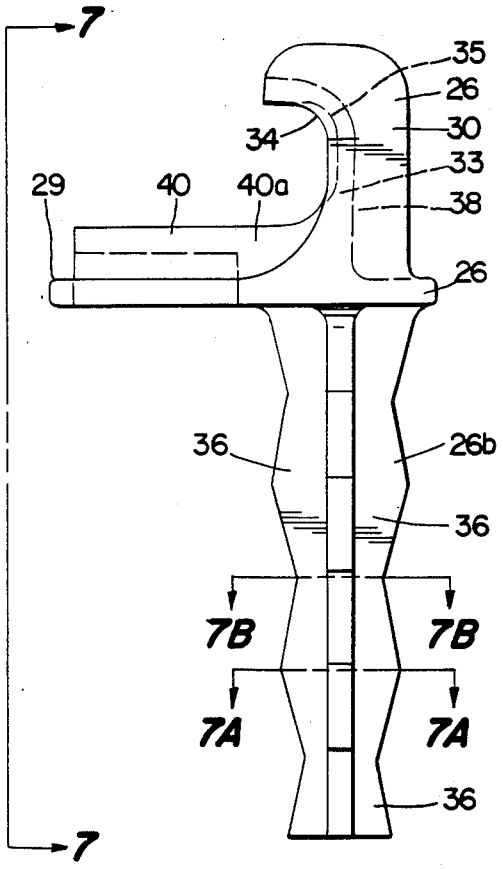
FIG. 5 is an elevational view of a retaining chair used in the fastening assembly of FIG. 1.
Figure 7:
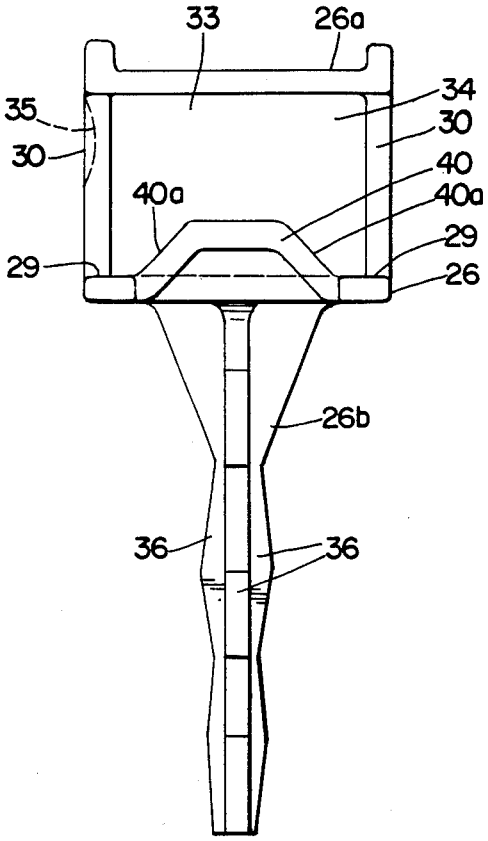
FIG. 7 is a side elevational view of the retaining chair of FIG. 5 taken generally along the plane of line 7—7 of FIG. 5 looking in the direction of the arrows.
Figure 6:
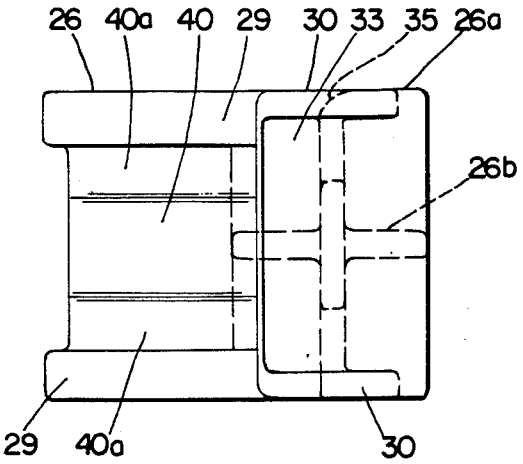
FIG. 6 is a top plan view of the retaining chair of FIG. 5.
Figure 7B:
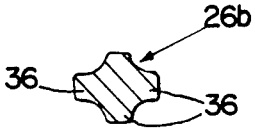
FIG. 7B is a sectional view taken generally along the plane of line 7B—7B of FIG. 5 looking in the direction of the arrows.
Figure 7A:
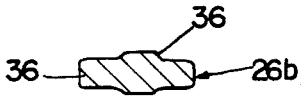
FIG. 7A is a sectional view taken generally along the plane of line 7A—7A of FIG. 5 looking in the direction of the arrows.

The retaining chair 20 comprises, in the embodiment illustrated, a body portion 26 (FIGS. 5-7), a head portion 26*a* projecting upwardly from the body portion, and a depending leg or anchoring portion 26*b* which is secured to the tie support 14. The retaining chair may be secured in the concrete tie support by any suitable means, but preferably is fixed thereto, or embedded therein, prior to curing of the tie, and as can be seen in FIG. 3. A slight recess 28 is preferably preformed in the top surface of the tie for receiving the body portion 26 of the retaining chair, so that the upper surfaces 29 of body portion 26 are substantially flush with the top surface of the tie.

For convenience in describing the structural arrangement, the side of the retaining chair head 26*a* that faces the rail 12 will be termed the innerside, while the opposite side of the retaining chair head 26*a* will be termed the outerside of the retaining chair head. Head 26*a* which may be of generally hook-shape in elevation (FIGS. 3 and 5) comprises front and rear flanges 30, connected by center web 33, which define a recess 34 on the outerside of the head 26*a*, which is adapted to receive therein in seating engagement, the fastener clip 22 as will be hereinafter described in greater detail. Head 26*a* is preferably beveled as at 35 to provide clearance for clip 22.

Figure 4:
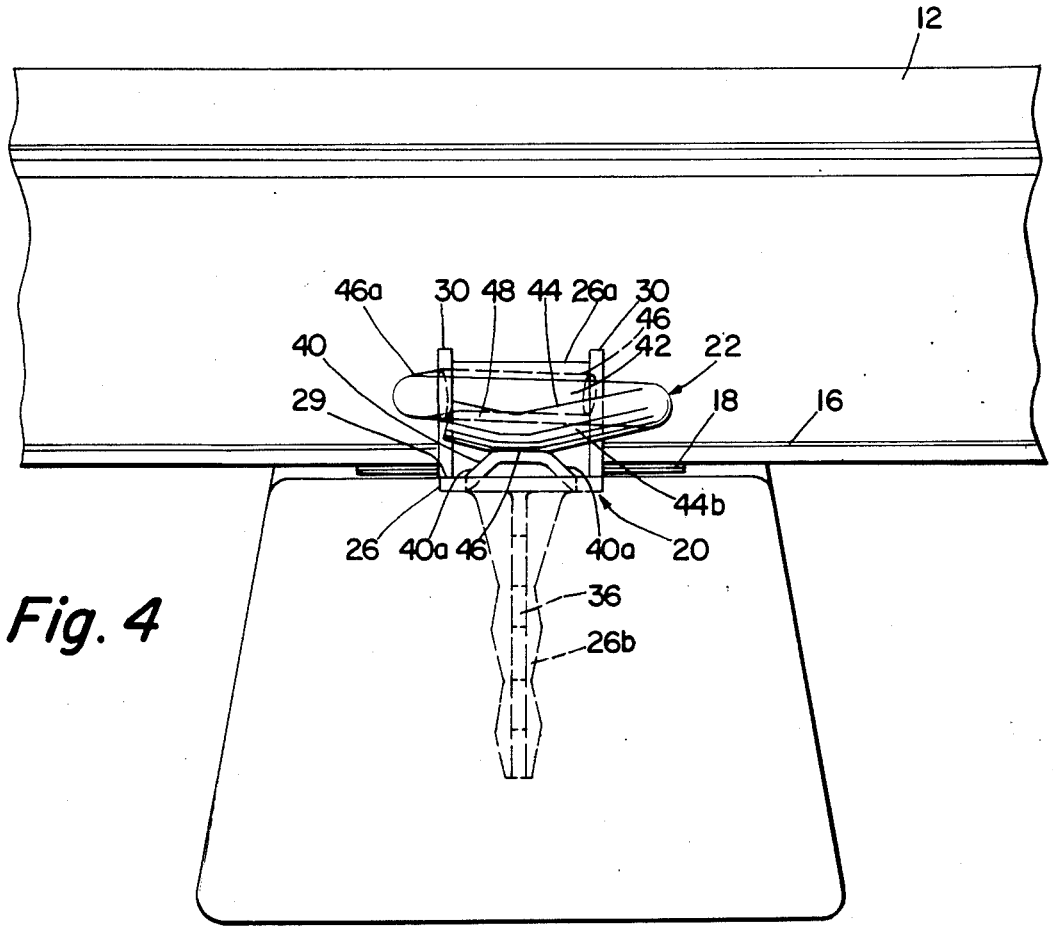
FIG. 4 is a fragmentary side elevational view of the FIG. 1 assembly.

The anchoring leg 26*b* of the retaining chair depends from the body portion 26 and includes in the embodiment illustrated, laterally projecting webs 36 which in a direction lengthwise thereof may be of generally sinuous configuration, as is best seen in FIGS. 2, 3 and 4. Such sinuous configuration helps in anchoring or securing the retaining chair in the tie 14.

Front and rear flanges 30 and central flange 33 of the chair anchor head 26*a* define a generally vertically extending pocket 38 on the innerside of the head 26*a*, for a purpose to be hereinafter described.

Disposed laterally of the head 26*a* of the retaining chair is ramp portion 40 which projects upwardly with sloping side surfaces 40*a*, from the body portion 26 of the retaining chair. Ramp portion 40 is adapted for camming coaction with the rail clip 22 as will be hereinafter described in greater detail. As can be best seen in FIGS. 3, 4, 5, 6, and 7, the ramp structure 40 merges smoothly with the central web 33 as well as with body portion 26 and the front and rear flanges 30 of the head.

Figure 10:
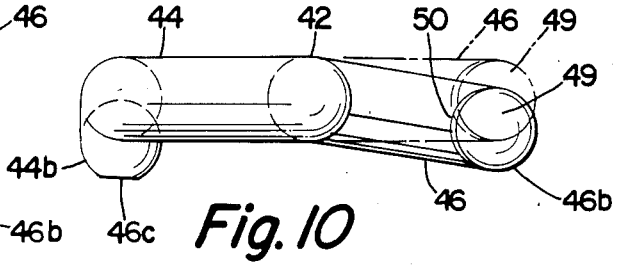
FIG. 10 is an end elevational view of the clip of FIG. 8 taken generally along the plane of 10—10 of FIG. 8 looking in the direction of the arrows; in phantom lines there is illustrated the position of the clip when it is in assembled condition with an associated retaining chair.
Figure 11:
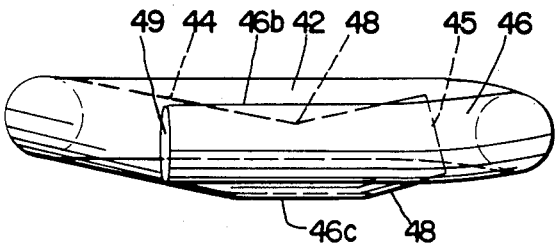
FIG. 11 is a side elevational view of the S-clip of FIG. 5 taken in general along the plane of line 11—11 of FIG. 8 looking in the direction of the arrows.
Figure 9:
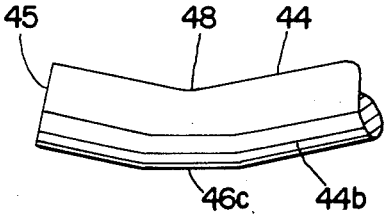
FIG. 9 is a fragmentary side elevational view taken generally along the plane of line 9—9 of FIG. 8 looking in the direction of the arrows.

Clip 22 is generally S-shaped in plan, and comprises a central, generally linearly extending leg 42, a retaining chair bearing portion 44, and a rail bearing portion 46, spaced on opposite sides and extending from opposite ends of the central leg. The retaining chair bearing portion 44 comprises a first loop section 44*a* defined by an arcuate leg section, and a terminal leg section 44*b* forming an extension of the first loop 44*a*, and having a free distal end 45. As can be best seen in FIGS. 9 and 10, the underside of the terminal leg section 44*b* upstream from end 45 thereof, is preferably provided with a flat 46*c* which is adapted for seating engagement with the generally planar top surface of the aforementioned ramp 40, in the assembled condition of the clip with the retaining chair. As can be best seen in FIGS. 9 and 11, the terminal leg section 44*b* extends downwardly relative to the central leg 42 of the clip and then is bent as at 48 so as to turn upwardly generally adjacent the distal end, for camming coation with the aforementioned ramp 40, during assembly of the clip on the retaining chair.

Figure 8:
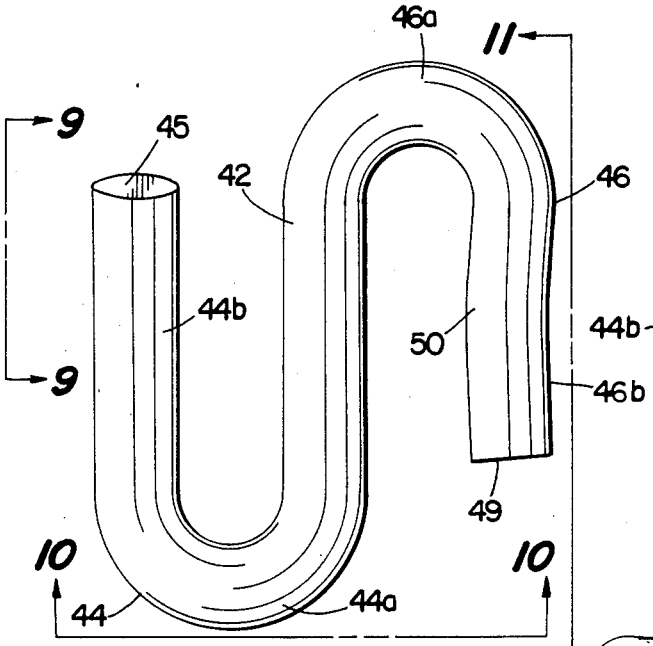
FIG. 8 is a top plan view of one of the S-clips of the rail assembly of FIG. 1.

The rail bearing portion 46 of the clip comprises what will be designated as a second loop 46*a* of the clip, defined by an arcuate leg section and a terminal leg section 46*b*, forming an extension of the second loop, and having a free distal end 49. As can be best seen from FIGS. 10 and 11, the rail bearing portion extends downwardly relative to the central leg 42 in the non-stressed condition of the clip. The S-clip may be formed of spring steel bar stock, of the general type aforedescribed in aforemention U.S. patent application Ser. No. 933,630, and may be heat treated as described therein, to provide the finished clip. The terminal leg section 46*b* is preferably bent inwardly toward the central leg 42, and then outwardly as at 50, as best seen in FIG. 8 to form a protuberance or detent portion 50 which is adapted for locking coaction with complementary means on the retaining chair assembly (and in this embodiment, with means on the insulating pad 24) in the assembled condition of the clip with the retaining chair and pad, as will be hereinafter described in greater detail.

Figure 12:
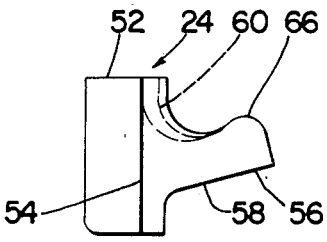
FIG. 12 is a side elevational view of one of the insulators or shims of the fastening assembly of FIG. 1.

The insulating shim or part 24 (FIGS. 12 and 13) may be formed of any suitable insulating material, but is preferably formed of a plastic, such as for instance nylon, in combination with fiberglass or a polyester and fiberglass, and is preferably an item molded under heat and pressure. Insulator pad 24 is adapted to be interposed, as aforementioned, between the rail bearing portion 46 of the clip, and the underlying associated flange 16 of the rail, to hold, in conjunction with the spring clip, the rail in position on the support 14. The insulator is adapted to electrically and mechanically insulate the chair means and rail clip from the railway rail. "Mechanically" as used here means in general separating the clip from direct contact with the rail, and absorbing vibration and wear between the rail and the fastening assembly.

Insulator 24 comprises a head section 52, which is adapted to be received in movable but relatively close fitting relation, in the aforementioned pocket 38 on the innerside of the head of the retaining chair; and between the front and rear flanges 30 thereof, and as can be best seen in FIG. 2. Generally vertically extending lateral shoulders 54 are preferably provided on either end of the head portion 52 and are adapted to guide the insulator during any vertical movement thereof relative to the retaining chair during passage of a train along the railway track, the latter causing some dynamic movement of the rail relative to the retaining chair member 20.

Ramp portion 56 of the insulator projects laterally of head portion 52 and is adapted to engage the adjacent rail flange 16 as can be seen in FIG. 2. It will be seen that when the head portion 52 is received in the pocket 38 of the retaining chair, the insulator pad can move vertically relative to the chair, but is restricted in lateral and longitudinal movement of the pad with respect to the retaining chair. The insulator pad preferably includes recess 58 on its underside conforming to the general contour of the confronting base flange of the railway rail, for engagement therewith.

Figure 13:
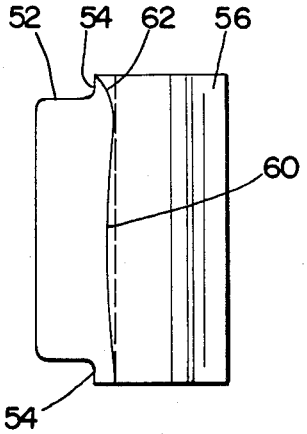
FIG. 13 is a top plan view of the insulator of FIG. 12.

The upper side of pad 24 is preferably provided with a concavity or slight indentation 60 (FIGS. 12 and 13) which is adapted for coaction with the aforementioned protuberance 50 on the S-clip 22, for establishing a locking engagement therewith, and thus aiding in maintaining the clip and retaining chair and insulator in assembled relationship during application of the various forces which are applied to the assembly during the passage of a train along the track, thus maintaining a positive restraining or securing force on the rail under all conditions of use regardless of the forces applied thereto. As can be seen in FIG. 13, one end of the concavity 60 is beveled outwardly as at 62 for insuring entry movement of the rail bearing portion 46 of the clip into locking engagement with the pad upon driving or pressing of the S-clip onto the retaining chair. In this connection and referring to FIG. 8, it will be seen that the outwardly bent free end section 49 of the S-clip aids in camming coaction of the S-clip bearing portion into locking engagement with insulator pad or shim 24. The distal end portion of the lateral ramp 56 of the pad preferably is protruded or formed slightly upwardly as at 66, aiding in maintaining the locked condition of the clip with the retaining chair and insulator assembly. If insulator pad 24 becomes worn in use, the clip 22 can be disassembled from the retaining chair, and the insulator can be readily replaced with a new insulator, without the necessity of replacing the whole fasteing assembly.

Retaining chair 20 may be formed of a heat treated ductile iron casting having a Rockwell hardness on the C scale within the range of approximately 35 to 45 and having an ultimate strength generally exceeding 100,000 p.s.i. The retaining chair casting illustrated preferably weighs approximately $2\frac{1}{2}$ pounds and thus is much lighter than heretofore used chairs conventionally made of malleable iron castings, which generally weigh between 3 to $3\frac{1}{2}$ pounds per member. The retaining chair arrangement of a heat treated ductile iron casting gives greater strength with less weight, and therefore is preferred as compared to malleable iron castings, in the formation of the railway track fastening systems. High strength ductile iron which has not been heat treated may also be used for the chair casting, such as, for instance, 65-45-12 ductile iron or 80-55-06 ductile iron.

Assembly of the S-clip onto the retaining chair is preferably accomplished by driving or pressing the S-clip 22 onto the assembled retaining chair 20 and insulator 24, in the direction of the full line arrows illustrated in FIG. 1. During such assembly movement, the central leg of the S-clip is received in the recess 34 of the retaining chair, while the retaining chair bearing portion 44 engages and moves up the ramp 40 on the chair, while the rail bearing portion 46 coacts with and slides along the top surface of the ramp section 56 of the insulator pad 24, thus applying a torsional force to both ends of the center leg 42 of the clip, which is seated against the upper portion of the defining surface of recess 34, thus restaining upward movement of the central leg 42 of the clip relative to the retaining chair. In the fully assembled condition, the flat 46*c* on the underside of the retaining chair bearing portion 44 of the clip engages the top surface of the ramp 40 on the retaining chair, while the rail bearing arm 46 bears down against the top surface of the insulator pad 24, firmly holding the insulator against the rail flange 16, and thus firmly holding the rail in place on its tie support 14. It will be seen that the lever arm of the rail bearing portion is relatively short, due to the close proximity of the retaining chair to the rail, which facilitates the holding down of the rail by the fastening assembly during passage of a train over the rail. The dynamic forces applied to the rail and thus to the fastening assembly may cause the insulating pad 24 to move vertically relative to the retaining chair which vertical movement of the pad can occur due to its vertically movable condition in the pocket of the head 26*a* of the retaining chair. However, lateral and longitudinal movement of the insulating pad is prevented as aforedescribed, and thus the rail is firmly held relative to the support fastening assemblies.

Referring now in particular to FIGS. 2 and 3, it will be seen that the innerside of the head of the retaining chair is configured so that it is substantially smooth in the vertical direction, without any identations or sharp interruptions in the front and rear flanges 30. It can be seen from FIG. 3 that a pair of the retaining chairs as secured to the concrete tie support 14 are disposed in relatively close relationship to one another, and so as to be in close proximity to the base flange of the rail, when the latter is assembled therebetween. The generally smooth vertical defining configuration of the retaining chair heads provides a means for aiding in guiding the rail onto the support 14 between the pair of retaining chairs, during assembly of the rail onto the support, and without the possibility of snagging or catching the rail in or on the head of the retaining chair during such assembly process. Accordingly, this facilitates the assembly of the rail onto the tie supports and expedites the building of a track.

When the rail is in assembled position on the tie pad 18, it will be seen that the lateral extremities of the rail flanges are in close proximity to the heads of the retaining chairs and that the lever arm of each of the clips from the central leg section where it is disposed in seated engagement with the head of the respective retaining chair and the rail bearing portion, is relatively short, thus insuring a greater resistance to vertical movement of the rail relative to the retaining chair and insulator pad assembly rail during passage of a train over the tracks.

Referring now to FIGS. 14–24, there is illustrated another embodiment of fastener assembly. In this embodiment, there is no insulator or shim provided between the rail bearing portion of the S-shaped clip and the flange 16 of the rail, and thus the rail is in direct contact with and in electrical conducting relation to the metal clip 22'. However, in the event that it is desirable or necessary to insulate the fastening assembly from the rail support 14, in this embodiment the retaining chair may be coated with a layer 70 (FIG. 15) of electrical insulating material, such as for instance a layer of high density polyethylene. However, it will be understood that other materials capable of withstanding the physical and electrical forces to which the retaining chair will be subjected, can be alternately utilized. Such layer 70, which preferably incapsulates not only the anchoring leg 26*b'* of the respective retaining chair but also the body portion 26', effectively electrically and mechanically insulates the chair rail from the support 14. The tie pad 18, which likewise is preferably of electrical insulating material, such as polyethylene, electrically and mechanically insulates the rail 12 from the support 14.

Moreover, in this embodiment the retaining chair 20' has no pocket formed on the innerside thereof for receiving any insulating pad and the rail bearing portion 46' of the generally S-shaped clip 22' directly engages the adjacent flange 16 of the rail, to effectively hold it down in tensioned relationship against the tie pad 18 and rail support 14. In this connection, it will be seen that the rail bearing portion 46' of the clip 22' is preferably provided with a flat surface 72 (FIGS. 22 and 24) thereon, which is adapted for bearing engagement with the upwardly sloping top surface of the associated flange 16 of the rail 12.

Figure 22:
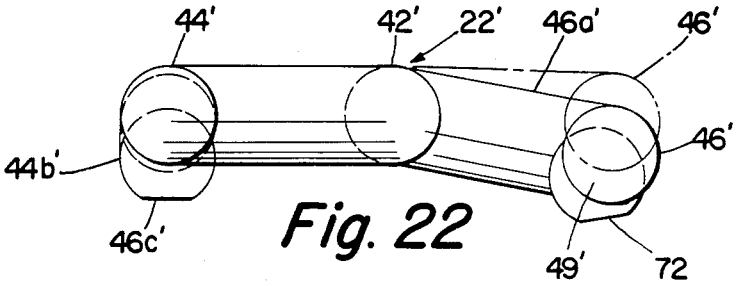
FIG. 22 is an end elevational view of the clip of FIG. 21 taken generally along the plane of line 22—22 of FIG. 21 looking in the direction of the arrows; in phantom lines there is illustrated the tensioned condition of the clip when assembled with a retaining chair.
Figure 23:
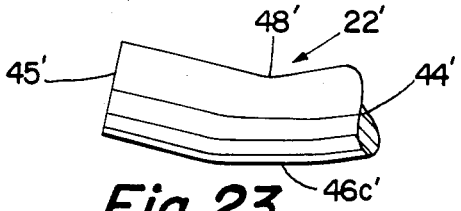
FIG. 23 is a fragmentary, side elevational view taken generally along the plane of line 23—23 of FIG. 21 looking in the direction of the arrows.
Figure 24:
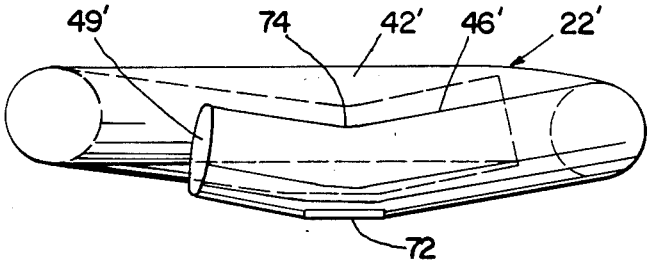
FIG. 24 is a side elevational view of the clip of FIG. 21 taken generally along the plane of line 24—24 of FIG. 21 looking in the direction of the arrows.

As can be seen in FIG. 22, in the unassembled nontensioned condition of the clip 22' the flat surface 72 is disposed at an angle of approximately 10° with respect to the horizontal. In the tensioned assembled condition of the clip, the flat surface 72 is adapted to engage in surface-to-surface relation with the sloping top surface of the adjacent flange 16 of the rail, such surface being disposed at an angle of approximately 15° with respect to the horizontal. Moreover, and as can be best seen in FIGS. 22 and 24, the rail bearing portion 46' of the S-shaped clip 22' initially slopes downwardly relative to the axis of the central leg 42' and then is bent as at 74 to slope upwardly. This facilitates the commencement of movement of the clip onto the hook-shaped head of the retaining chair, and onto the adjacent flange of the rail during the driving or pressing of the clip 22' into assembled relationship with the retaining chair. The rail bearing portion 46' of clip 22' is similarly provided with a detent or protruberance 50' adapted for coaction with the recess or concavity 60' (FIG. 19) formed in the head 26*a'* of the retaining chair 20', for locking the clip in position with respect to the retaining chair. As can be best seen in FIG. 18, the concavity 60' preferably extends vertically a considerable distance and in the embodiment illustrated for almost the full height of the head 26*a'*, and provides for relative vertical movement of the rail bearing portion of the clip with respect to the retaining chair head during application of dynamic force to the fastening assembly during the passage of a train over the tracks, as aforedescribed.

Figure 14:
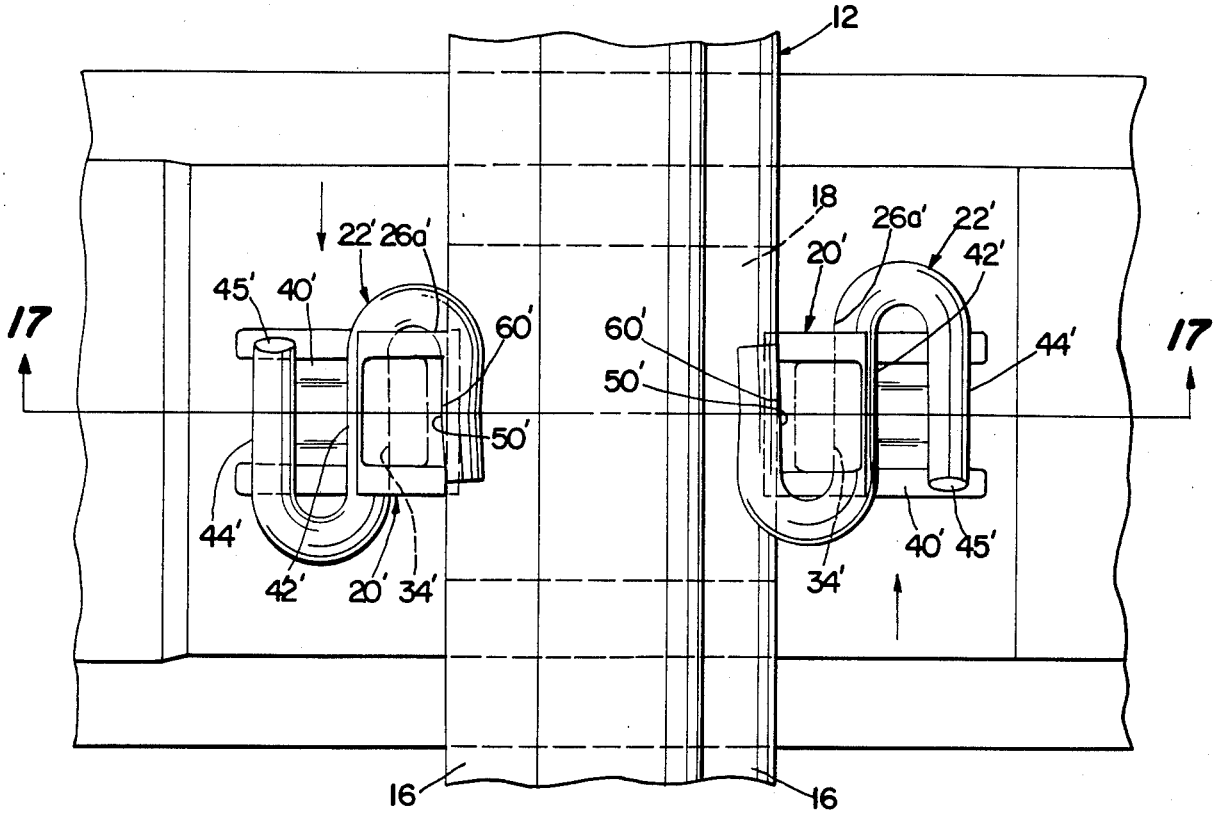
FIG. 14 is a top plan, fragmentary, view of another embodiment of fastening assembly.
Figure 15:
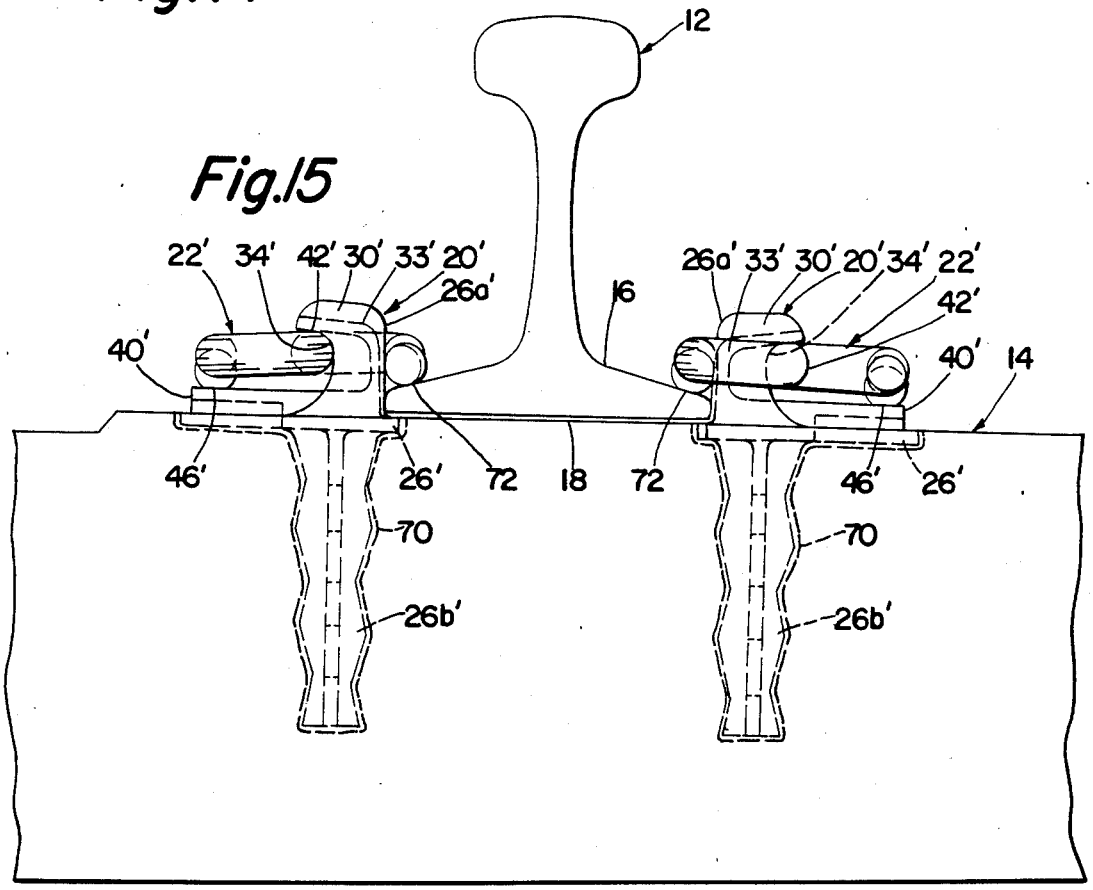
FIG. 15 is an end elevational view of the FIG. 14 assembly.
Figure 17:
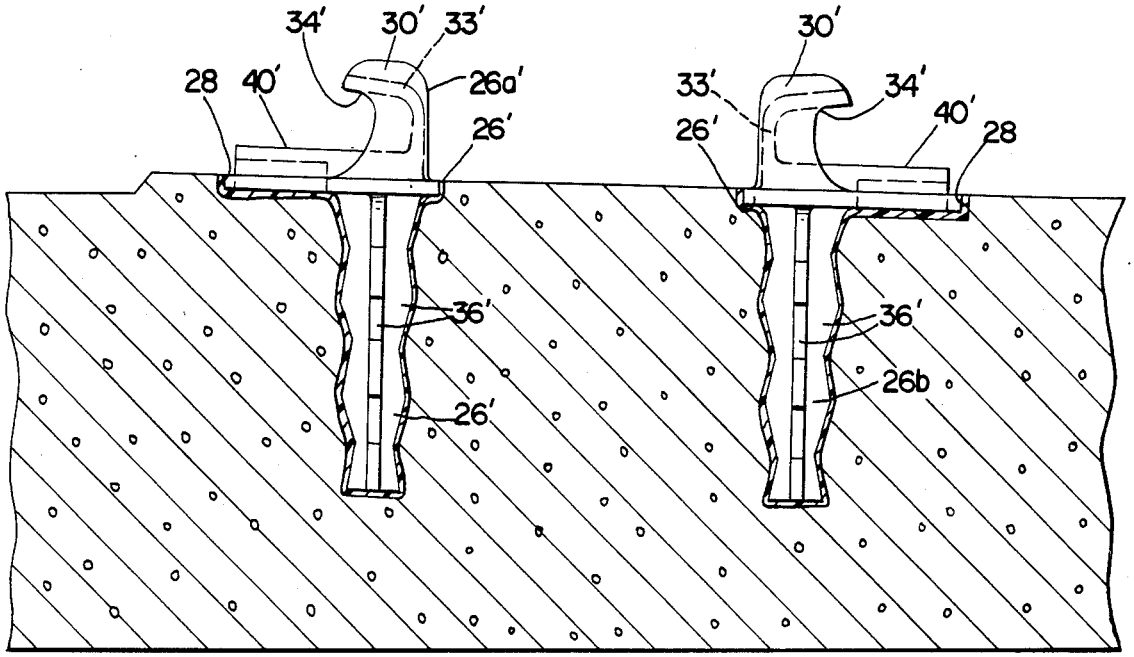
FIG. 17 is a sectional view taken along the plane of line 17—17 of FIG. 14 showing a pair of the retaining chairs of the fastening assembly of FIG. 14 ready for receiving the railway rail therebetween, the rail and clips having been eliminated.
Figure 16:
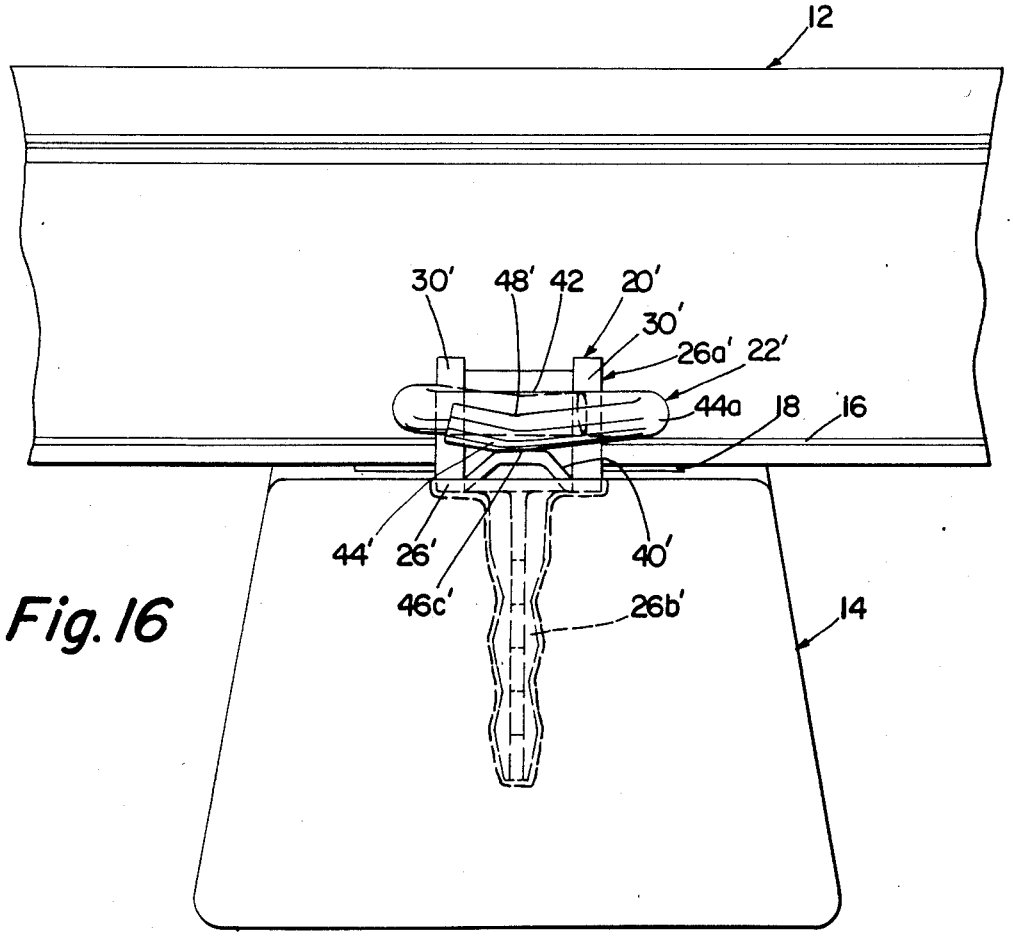
FIG. 16 is a side elevational view of the FIG. 14 assembly.
Figure 18:
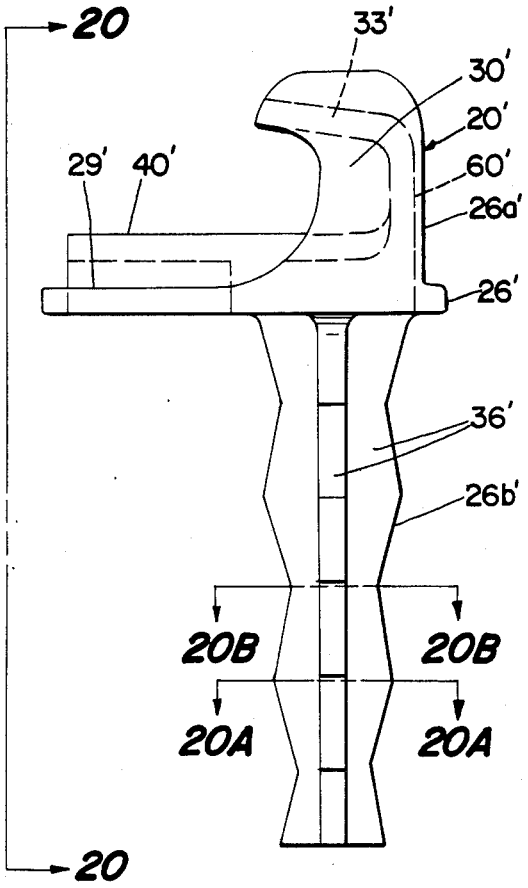
FIG. 18 is an elevational view of a retaining chair of the fastener assembly of FIG. 14.
Figure 20:
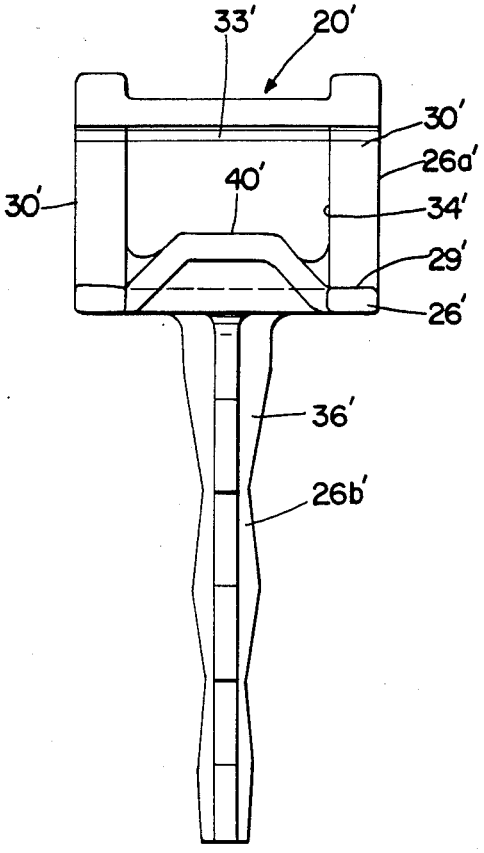
FIG. 20 is a side elevational view of the retaining chair of FIG. 18 taken generally along the plane of line 20—20 of FIG. 18.
Figure 19:
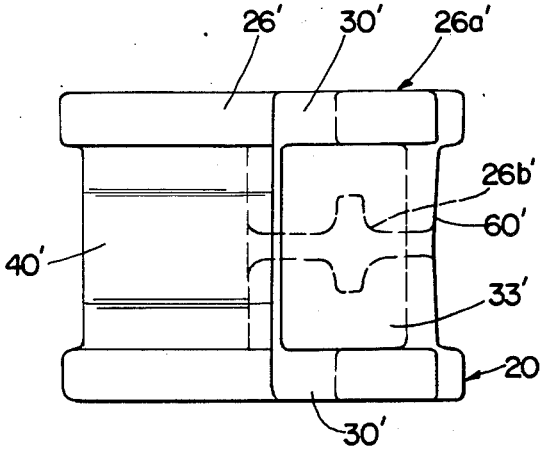
FIG. 19 is a top plan view of the retaining chair of FIG. 18.
Figure 20B:
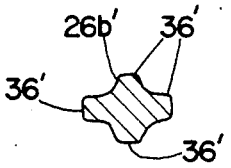
FIG. 20B is a sectional view taken generally along the plane of line 20B—20B of FIG. 18.
Figure 20A:
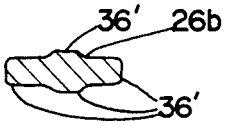
FIG. 20A is a sectional view taken generally along the plane of line 20A—20A of FIG. 18.
Figure 21:
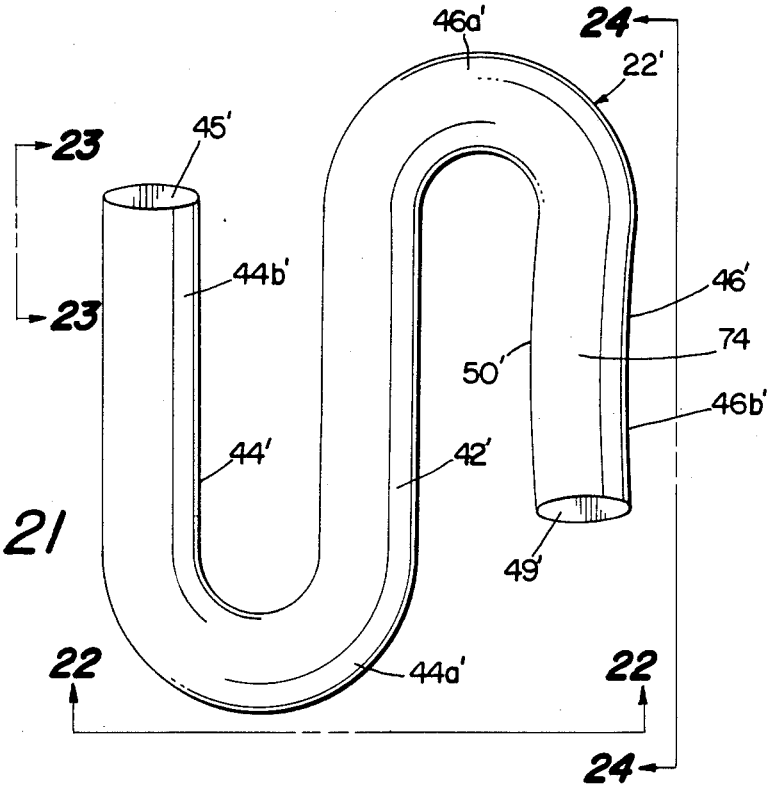
FIG. 21 is a top plan view of one of the S-clip members of the fastening assembly of FIG. 14.

In other respects, the FIGS. 14–24 embodiment may be generally similar to those of the first described embodiment; assembly of the clip onto the retaining chair member can be accomplished in a generally similar manner as described in connection with the first embodiment, with the clip being positioned with respect to the retaining chair head so that the central leg 42' thereof is in position to be received within the recess 34' of the retaining chair head, and with the rail bearing arm being positioned on the flange 16 of the rail, and upon driving or pressing of the clip in the direction of the full line arrows in FIG. 14, the clip moves transversely of the head with the retaining chair bearing portion including the loop 44*a'* being cammed up the ramp portion 40' of the retaining chair until the central leg is received in its seated engagement in the recess 34' of the head, at which time considerable torsional force is applied to the ends of the central leg, as it is held by the retaining chair from moving upwardly from its seated relationship in the hook-shaped recess of the head.

It will be noted that the head 26*a*′ of this fastening assembly again has a substantially uninterrupted inner surface in a vertical direction, and therefore facilitates the positioning of the rail between a pair of the retaining chairs, with such heads serving to guide the rail therebetween, and to be properly positioned between the retaining chairs, without a problem of snagging or catching occurring between the rail and the chair heads during installation of the rail on the support 14. The retaining chairs of the FIGS. 14–24 embodiment may be formed of heat treated ductile iron or non-heat treated ductile iron, while the S-shaped clips are preferably formed from spring steel bar stock which may be of the type set forth in aforementioned U.S. patent application Ser. No. 933,630, and as aforedescribed in connection with the first embodiment of the fastening assemblies.

From the foregoing discussion and accompanying drawings it will be seen that the invention provides a novel rail fastening assembly for securing a railway rail to a support, such as a tie, with the assembly comprising a retaining chair adapted to be positioned adjacent the rail base flange on the support and a generally S-shaped torsional spring rail clip including a central leg, a retaining chair bearing portion and a rail bearing portion, spaced on opposite sides and extending from opposite ends of the central leg, with the central leg being adapted to coact with means on the head of the retaining chair for establishing a torsional spring force on the central leg and which results in securing the railway rail to the support, and with the means on the head coacting with the central leg being disposed on the outerside of the head facing in a direction away from the rail.

The invention also provides a novel rail fastening assembly wherein the retaining chair means can be assembled in closer proximity to the rails as compared with heretofore utilized clip type fastening assemblies, for facilitating the fastening of the rails to the tie support and also for providing an arrangement which aids in guiding the rail between the retaining chair means during assembly of the rail onto the support.

The invention also provides novel S-shaped spring rail clip members adapted for coaction with a respective retaining chair, and in one embodiment there is provided a replaceable insulator shim or pad coacting between the rail bearing portion of the S-shaped clip and the rail flange, for electrically and mechanically insulating the rail from the fastening assembly, and in another embodiment, the anchoring portion of the retaining chair is provided with an electrical insulating coating, for insulating the chair member from electrical transmitting relation with the tie support.

The terms and expressions which have been used, are used as terms of description and not of limitation, and there is no intention in the use of such terms and expressions of excluding any equivalents of any of the features shown, or described, or portions thereof, and it is recognized that various modifications are possible within the scope of the invention claimed.

What is claimed is:

1. A drive-on rail fastening assembly for securing a railway rail having a laterally projecting base flange, to a support therefor, said assembly comprising a generally S-shaped, in plan as well as in perspective, torsional spring rail clip including a singular generally linear central leg, the latter adapted to be generally horizontally oriented and adapted to extend in the general lengthwise direction of extension of the rail, and a retaining chair bearing portion and a rail bearing portion spaced on opposite sides and extending from opposite ends of the central leg, said chair bearing and said rail bearing portions each comprising an arcuate loop section and a terminal leg section, said leg section of said rail bearing portion being a leading leg and said leg section of said chair bearing portion being a trailing leg, chair means adapted to be positioned adjacent said rail base flange, on said support and to coact with said clip for establishing a torsional spring force on said central leg for securing the railway rail, said chair means including a head having an inner side and an opposite outer side, recess means on said head for receiving said central leg in seating engagement therewith, said inner side of said head being adapted to face said rail, and having a generally smooth defining periphery in a vertical direction as viewed in elevation so as to prevent inadvertent snagging of the rail base on said chair means during installation of the rail on said support, said recess means opening onto said outer side of said head, and being disposed laterally outwardly of the rail base flange, ramp means on said chair means disposed laterally of said outer side of said head, an insulating member disposed intermediate said rail bearing portion of said rail clip and said base flange of the railway rail, electrically and mechanically insulating said chair means and said rail clip from said railway rail, said member including a recess on its underside adapted to conform to the confronting base flange of the railway rail, said member on its upperside including means adapted for coaction with said clip for establishing a locking engagement therewith, said member including a laterally extending head portion received in relatively close fitting relation in a pocket formed in the confronting inner side of said head, and generally vertically extending lateral shoulders on either end of said head portion outwardly of said pocket adapted to guide said member during vertical movement thereof relative to said chair means, said ramp means establishing a generally upwardly directed force on said chair bearing portion of said clip when said clip is driven onto said chair means in a direction generally lengthwise of said rail, thus establishing oppositely directed torsional forces on said central leg resulting in positive restraining force by said clip on the rail.

2. A rail fastening assembly in accordance with claim 1 wherein said chair means comprises a heat treated ductile iron casting having a Rockwell hardness on the C scale of between approximately 35 to 45.

3. A rail fastening assembly in accordance with claim 1 wherein said chair means weighs approximately 2½ pounds, of non-heat treated high strength ductile iron.

4. A rail fastening assembly in accordance with claim 1 wherein said head is of generally hook-shaped configuration in elevation, said recess means being configured to receive the central leg of said rail clip in seated engagement to provide a restraining force thereon, the defining periphery of said recess means in elevation extending generally vertically upwardly and then turning smoothly and extending outwardly to open onto said outer side of said head.

5. A rail fastening assembly in accordance with claim 1 wherein said support comprises a concrete tie with said chair means being anchored in said tie, and with said head projecting upwardly relative to the upper surface of said tie.

6. A rail fastening assembly in accordance with claim 1 wherein said member is an insulator comprised of a plastic-fiber-glass composition.

7. A rail fastening assembly in accordance with claim 1 wherein said chair means head includes a pocket formed on said inner side thereof receiving said member therein and positioning the latter with respect to said chair means, said pocket providing for vertical movement of said member relative to said chair means in use, but preventing general longitudinal and lateral movement of said member with respect to said chair means and said railway rail, said member including a laterally extending head portion received in relatively close fitting relation in said pocket in the confronting inner side of said head and generally vertically extending lateral shoulders on either end of said head portion outwardly of said pocket adapted for movingly engaging the confronting generally vertical surfaces of said chair means head upon vertical movement of said member relative to said chair means, said member including a ramp portion extending laterally from said shoulders to overlie said rail base flange, said ramp portion on its upper surface comprising a generally concave surface section receiving in engaged relation said rail bearing portion of said S-clip.

8. A rail fastening assembly in accordance with claim 7 including means on said member for camming said rail bearing portion of said clip relative to said member during driving of said clip onto said chair means and coacting member, and urging said central leg into seating engagement with said head.

9. A fastening assembly in accordance with claim 8 wherein said member includes a laterally extending block-like head portion received in relatively close fitting relation in a pocket formed in the confronting inner side of said chair means head and generally vertically extending lateral shoulders on each end of said head portion disposed outwardly of said pocket and adapted for guiding coaction with confronting surfaces on said chair means head for guiding vertical movement of said member relative to said chair means, said shoulders being of substantially the same height as said head portion.

10. A rail fastening assembly in accordance with claim 9 wherein said member includes a projecting ramp portion overlying said base flange of said rail and adapted for camming coaction with said rail bearing portion of said clip, for establishing a torsional spring force on said central leg of said chip, said ramp portion on its upper surface comprising a generally concave surface section receiving in engaged relation said rail bearing portion of said S-clip, said member including a block-like head portion extending laterally from said ramp portion, said head portion being received in relatively close fitting relation in a pocket formed in said inner side of said chair means head, and a generally vertically extending lateral oriented shoulder on each end of said head portion, disposed outwardly of said pocket and adapted for engaging coaction with confronting surfaces on said chair means head laterally of said pocket, for guiding vertical movement of said member relative to said chair means, said shoulders being of substantially the same height as that of said head portion.

11. A rail fastening assembly in accordance with claim 1 wherein said chair means comprises anchoring means adapted for anchoring the chair means in said support.

12. A rail fastening assembly in accordance with claim 11 wherein said anchoring means includes a layer of electrical insulating material thereon for electrically insulating said chair means from said support.

13. A rail fastening assembly in accordance with claim 1 wherein said head of said chair means includes means adapted for coaction with said rail bearing portion for establishing a locking engagement therewith.

14. A fastening assembly in accordance with claim 1 wherein said chair means includes an anchoring leg depending from said head, said anchoring leg adapted to be anchored in said support, said anchoring leg in transverse section including laterally projecting webs, said webs in a direction lengthwise of said anchoring leg being of generally sinuous configuration, and generally diminishing in width from the upper ends thereof toward the lower ends thereof.

15. A fastening assembly in accordance with claim 1 wherein said chair means comprises a platform-like body portion supporting said head and a leg portion depending from said body portion, said leg portion including laterally projecting webs, said webs in a direction lengthwise of said leg portion being of generally sinuous configuration and generally diminishing in width from the upper ends thereof toward the lower ends thereof, said leg portion being adapted for anchoring in the rail support, said body portion being adapted for location adjacent the upper surface of the support and said head being adapted for projecting above said support in close proximity to the rail, said body portion including said ramp means which is disposed laterally of said outer side of said head, said ramp means adapted for coaction with said chair bearing portion of said rail clip for establishing a torsional spring force on said central leg of said clip, said head being of generally hook-shaped configuration in elevation and comprising front and rear end flanges and a center web connecting said end flanges, said center web in conjunction with said end flanges defining said recess means opening onto said outer side, the defining periphery of said recess means in elevation extending generally vertically upwardly and then turning smoothly outwardly and extending generally horizontally to open onto said outer side of said head, said smoothly turning section of said recess means being adapted to receive said central leg of said clip in restraining engaging relation, with the peripheral configuration of said central leg being generally complementary to said smoothly turning section of said recess means.

16. A fastening assembly in accordance with claim 15 wherein said inner side of said head includes a pocket extending vertically from said body portion and between said end flanges, adapted to receive therein an insulator pad for insulating said S-clip from said rail base flange, the edges of said front and rear end flanges of said head facing said rail being smooth and non-indented, providing said generally smooth defining periphery in a vertical direction as viewed in elevation of said head, thus aiding in ensuring assembly of the rail on the support without snagging the rail base flange on said head, said defining periphery of said recess means being beveled on one of said end flanges adjacent the upper portion of said recess means to facilitate driving of said clip onto said chair means.

17. A relatively lightweight retaining device adapted for assembly with an S-shaped in plan as well as in perspective, torsional spring rail clip for securing a railway rail to a support, said device comprising a head and depending leg means, said leg means being adapted for securing the retaining device to a support, said head having an inner side and an outer side, said inner side being adapted to face an associated rail, and means on said outer side comprising an outwardly opening recess in said head for receiving an associated S-shaped in plan and in perspective, torsional spring clip in seating engagement therewith, for providing a restraining force on the singular generally linear central leg of the S-clip, said head comprising front and rear end flanges and a center web connecting said end flanges, said center web in conjunction with said end flanges defining said recess means opening onto said outer side and adapted to receive the central leg of the S-clip in seating and restraining engagement, the defining periphery of said recess means in elevation extending generally vertically upwardly and then turning smoothly to extend generally horizontally outwardly and open onto said outer side of said head, said inner side of said head including a pocket adapted for receiving an insulating member therein for insulating the S-clip from the rail, and adapted to position the insulating member with respect to the retaining device head, and means on said head adjacent said pocket for in use, guiding vertical movement of the insulating member relative to the retaining device, said pocket being defined by said front and rear flanges and by said central web, the edges of said front and rear flanges which are on said inner side of said head providing said means on said head adjacent said pocket for guiding vertical movement of the insulating member, and ramp means on the same side of said head as said recess and disposed laterally of said recess, said ramp means being adapted to establish a generally upwardly directed force on the ramp engaging portion of the S-clip when the clip is driven onto said retaining device in a direction lengthwise of the rail, to establish torsional forces on the central leg of the S-clip, said smoothly turning section of said recess means being of the same general configuration and formed generally complementary to the peripheral configuration of the central leg of the S-clip.

18. A retaining device in accordance with claim 17 including means on said inner side of said head adapted for coaction with an associated generally S-shaped torsional spring clip, for establishing a locking engagement therewith.

19. A retaining device in accordance with claim 17 wherein said leg means in transverse section include laterally projecting webs, said webs in a direction lengthwise thereof being of generally sinuous configuration, and generally diminishing in width from the upper ends thereof toward the lower ends thereof, the wider portions of said sinuous configurations of said webs being generally matched with the narrower portions of said sinuous configurations of said webs, in a vertical direction with respect to said leg means.

20. A retaining device in accordance with claim 17 wherein said retaining device comprises a casting of heat treated ductile iron, having a Rockwell hardness on the C scale of between approximately 35 to 45.

21. A retaining device in accordance with claim 17 wherein said retaining device comprises a casting of high strength ductile iron which has not been heat treated.

22. A retaining device in accordance with claim 17 wherein said leg means includes an encasing layer of electrical insulating material for electrically insulating the retaining device from an associated support when secured thereto.

23. A retaining device in accordance with claim 17 including means on said inner side of said head adapted for aiding in guiding without snagging an associated rail onto a rail support, said head being of generally hook shaped configuration in elevation, the last mentioned means being provided by a generally smooth defining exterior periphery in a vertical direction of said head as viewed in elevation so as to prevent inadvertent snagging of the rail base on said retaining device head during installation of the rail onto the associated support.

24. An insulator adapted to be disposed intermediate a rail bearing portion of an associated S-clip in plan as well as in perspective, torsional spring clip and the base flange of a railway rail, for electrically and mechanically insulating the clip from the rail, said insulator including means thereon adapted for guiding coaction with an associated retaining chair for guiding vertical movement of the insulator relative to the retaining chair, said means comprising laterally spaced generally vertically extending shoulders on said insulator, and means adapted to be received in a pocket in the associated retaining chair, for connecting the insulator to the retaining chair, said connecting means comprising a laterally extending head portion of said insulator adapted to be received in relatively close fitting relation in the confronting pocket formed in the retaining chair, said shoulders being disposed on opposite ends of said head portion, and said insulator including a ramp portion extending generally obliquely with respect to said head portion and from said shoulders whereby the width of said ramp portion is greater than the width of said head portion, said ramp portion on its upper surface including a concave surface section for receiving in engaging relation the rail bearing portion of an associated S-clip.

25. An insulator in accordance with claim 24 including means thereon adapted for locking coaction with the associated clip, for locking the clip with respect to the insulator, the last mentioned means including a concavity formed on the upper side of the insulator for receiving therein a protuberance on the clip, in interlocking relation, one end of said concavity being beveled outwardly for aiding in entry movement of the associated clip into locking coaction with the insulator.

26. An insulator in accordance with claim 24 wherein it is comprised of a plastic-fiberglass composition.

27. An insulator in accordance with claim 24 wherein said shoulders are of narrow width as compared to the width of said head portion, and are of elongated height, extending for the full height of said head portion, said ramp portion having on its underside thereof a recess formed generally complementary to the outer surface configuration of the base flange of the associated rail for being received in generally supported relation on the base flange of the associated rail, and wherein at least one of said shoulders is beveled outwardly to facilitate the entry of the rail bearing portion of the associated S-clip onto the insulator upon assembly thereof.

28. An insulator in accordance with claim 27 including means thereon for camming an associated S-shaped in plan, torsional spring, rail fastening clip relative to the insulator during the assembly of the clip onto an associated retaining device and coacting insulator.

29. An insulator in accordance with claim 27 wherein said ramp portion slopes upwardly and extends laterally of said head portion a greater distance than said head portion extends laterally of said ramp portion, for camming coaction with an associated S-shaped in plan, torsional spring, rail fastening clip during assembly thereof, said head portion being of block-like configuration, and being of a substantially greater height as compared to the height of said ramp portion.

30. An insulator in accordance with claim 29 which includes a protuberance on the upper extremity of the ramp portion for resisting movement of the clip off the ramp.

* * * * *